US009162348B2

(12) United States Patent
Ho

(10) Patent No.: US 9,162,348 B2
(45) Date of Patent: Oct. 20, 2015

(54) STEERING AND POSITIONING STRUCTURE OF A RATCHET SCREWDRIVER

(71) Applicant: Shih-Chi Ho, Taichung (TW)

(72) Inventor: Shih-Chi Ho, Taichung (TW)

( * ) Notice: Subject to any disclaimer, the term of this patent is extended or adjusted under 35 U.S.C. 154(b) by 246 days.

(21) Appl. No.: 13/932,215

(22) Filed: Jul. 1, 2013

(65) Prior Publication Data

US 2015/0000472 A1 Jan. 1, 2015

(51) Int. Cl.

| | |
|---|---|
| ***B25B 15/04*** | (2006.01) |
| ***B25B 23/00*** | (2006.01) |
| ***B25B 13/46*** | (2006.01) |

(52) U.S. Cl.

CPC ..... *B25B 15/04* (2013.01); *B25B 13/463* (2013.01); *B25B 23/0042* (2013.01)

(58) Field of Classification Search

CPC .... B25B 15/04; B25B 13/463; B25B 23/0042
See application file for complete search history.

(56) References Cited

U.S. PATENT DOCUMENTS

| | | | | |
|---|---|---|---|---|
| 5,974,915 | A * | 11/1999 | Chou | 81/63.1 |
| 6,389,932 | B1 * | 5/2002 | Ho | 81/62 |
| 6,435,061 | B1 * | 8/2002 | Ho | 81/58.4 |
| 7,311,186 | B2 * | 12/2007 | Liao | 192/43.2 |
| 7,398,710 | B1 * | 7/2008 | Ho | 81/63.1 |
| 8,720,307 | B2 * | 5/2014 | Shu | 81/63.1 |
| 2002/0079181 | A1 * | 6/2002 | Hsiao | 192/43.2 |
| 2009/0301264 | A1 * | 12/2009 | Klomp | 81/62 |
| 2012/0055290 | A1 * | 3/2012 | Chen | 81/63.1 |

* cited by examiner

*Primary Examiner* — David B Thomas
(74) *Attorney, Agent, or Firm* — Egbert Law Office, PLLC

(57) ABSTRACT

A steering and positioning structure of a ratchet screwdriver has a main body, ratchet assembly, radial holding tank, two upper snapping blocks in multi-tooth meshed pattern and two downward abutting pieces, as well as an elastic abutting member, revolving drum and revolving drum split positioning member. The upper snapping blocks are activated in tune with the downward abutting pieces, such that the upper snapping blocks can be formed by means of powder metallurgy and demolding. Multiple snapping teeth could be formed on the snapping blocks. As the snapping teeth can mated with the ratchets of the ratchet assembly in multi-tooth meshing pattern, the structure can meet the multi-tooth meshing structural demands for convenient forming, and also improve substantially the torsion of the ratchet screwdriver, enhance the ease-of-operation and mass production for higher economic benefits.

3 Claims, 7 Drawing Sheets

STEERING AND POSITIONING STRUCTURE OF A RATCHET SCREWDRIVER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a steering and positioning structure of a ratchet screwdriver, and more particularly to an innovative one which is adapted to a multi-tooth meshing mechanism for easy forming and demolding.

2. Description of Related Art Including Information Disclosed Under 37 CFR 1.97 and 37 CFR 1.98.

The ratchet screwdriver is a common handheld tool in everyday life, which is utilized in a unique manner that the screwdriver could be freely rotated positively (or reversely in idle state), reversely (or positively in idle state) or bi-directionally for ease-of-operation and convenience.

As for a conventional steering and positioning structure, a shaft lever with gearing assembled into the main body is used for guided meshing with the help of two □-shaped snappers and two abutting seats vertically inserted into the radial slot of the main body. Of which, the cross frame of said □-shaped snapper can be meshed with the gearing of the shaft lever, and the vertical frame of □-shaped snapper can be extended onto the abutting seat; when the user rotates positively or reversely the bushing sleeved onto the main body, an abutting seat can be pressed to push the corresponding □-shaped snapper, such that the snapper's cross frame is disengaged from the gearing, and another □-shaped snapper is meshed with the gearing for single-way rotation (in idle state it rotated in other direction).

Yet, as □-shaped snappers of the conventional steering and positioning structure are meshed with the gearing of the shaft lever only via the cross frame, insufficient torsion likely exists during rotation of the ratchet screwdriver. To resolve this problem, the gearing of the shaft lever is generally designed with coarse teeth with bigger pitch, so as to increase the meshing contact area of the □-shaped snapper's cross frame and the gearing, and also raise the rotational torsion; however, owing to bigger pitch of the gearing, the meshing, points for meshing rotation will decline when the ratchet screwdriver is used (□-shaped snapper's cross frame is meshed with the gearing only when the ratchet screwdriver is rotated to a specific angle). When space-saving is at a premium, the insufficient space likely causes interference to affect convenient use of the ratchet screwdriver or even causes its unavailability. For this reason, the gearing of the shaft lever is designed with fine teeth with smaller pitch. In such a case, insufficient torsion likely occurs due to single-tooth mating of the □-shaped snapper and the gearing during actual applications. Therefore, them-shaped snapper must be designed with a multi-tooth meshing pattern to increase the rotational torsion. As the □-shaped snapper is generally designed into a plate pattern (by means of punching), multi-tooth pattern could not be formed in the manufacturing process. If powder metallurgy is applied to the forming process, demolding is made impossible due to the □-shaped structure, bringing about big problem in manufacturing.

BRIEF SUMMARY OF THE INVENTION

Based on the unique design of the present invention wherein "the steering and positioning structure of a ratchet screwdriver" mainly comprises a main body, ratchet assembly, radial holding tank, two upper snapping blocks in multi-tooth meshed pattern and two downward abutting pieces, as well as an elastic abutting member, revolving drum and revolving drum split positioning member. The upper snapping blocks of the present invention are activated in tune with the downward abutting pieces, such that the upper snapping blocks could be formed by means of powder metallurgy and demolding. Meanwhile, multiple snapping teeth could be formed on the snapping blocks. As the snapping teeth could be mated with the ratchets of the ratchet assembly in multi-tooth meshing pattern, the present invention could meet the multi-tooth meshing structural demands for convenient forming, and also improve substantially the torsion of the ratchet screwdriver, enhance the ease-of-operation and mass production for higher economic benefits.

DETAILED DESCRIPTION OF THE INVENTION

Figure 1:
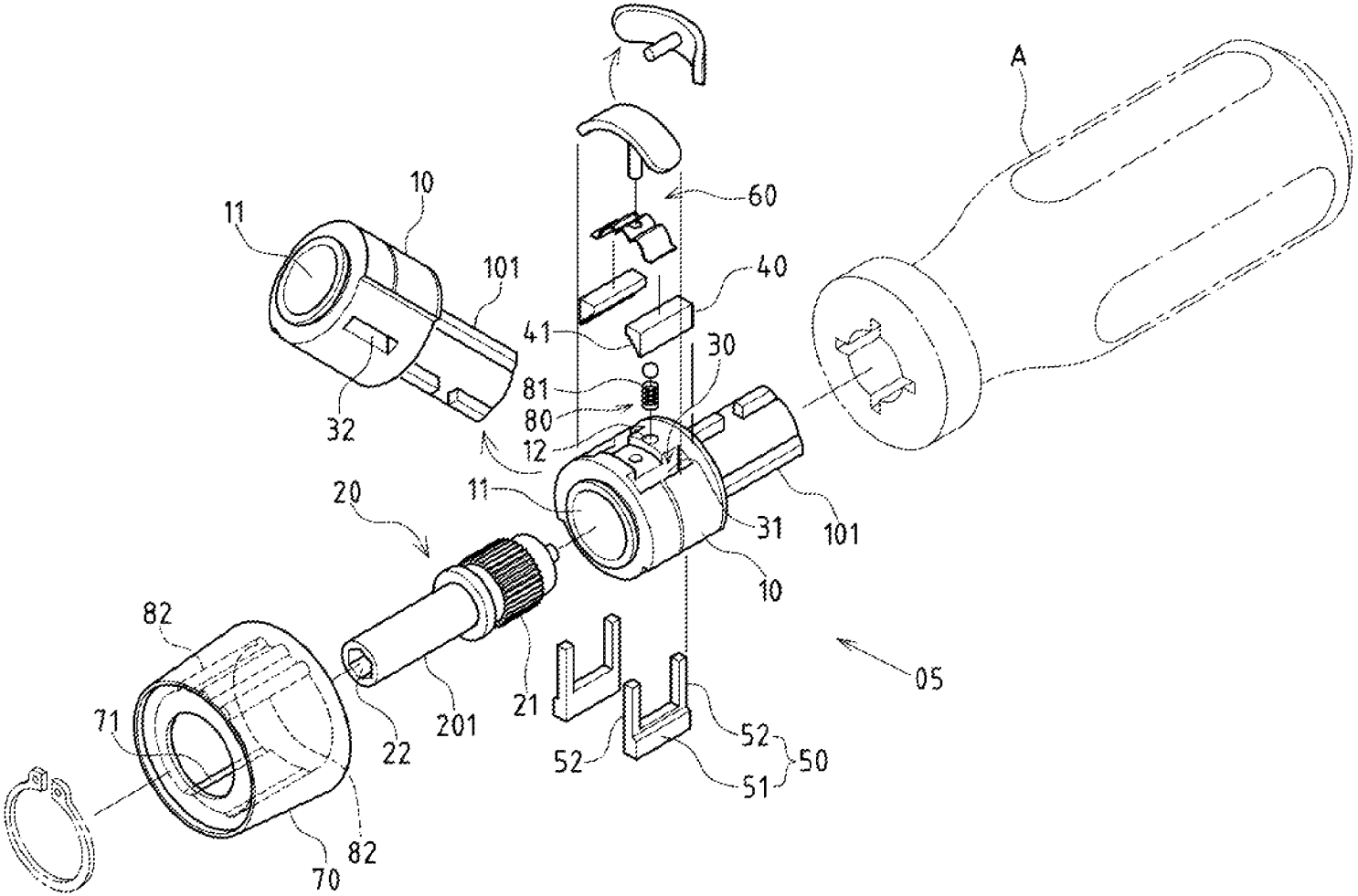
FIG. 1 is a perspective exploded view of the present invention.
Figure 2:
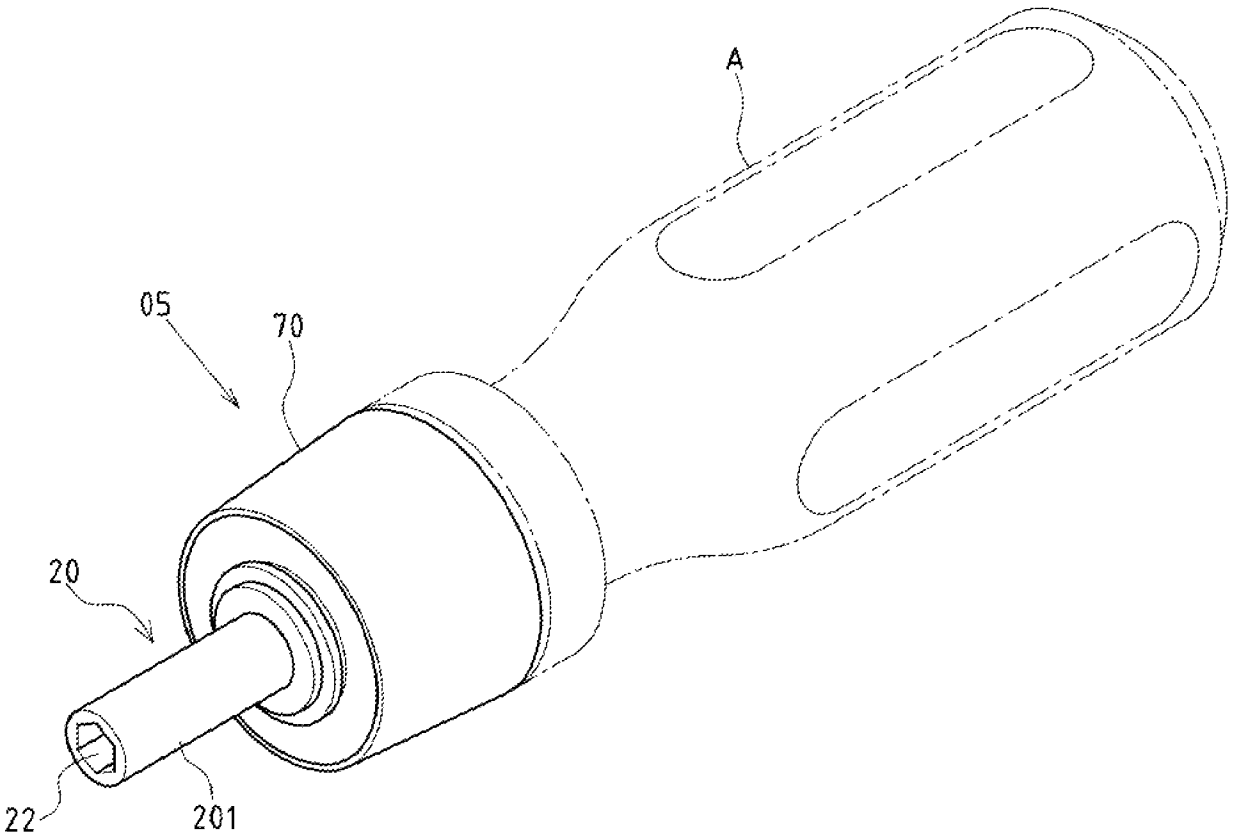
FIG. 2 is a perspective view of the present invention.
Figure 3:
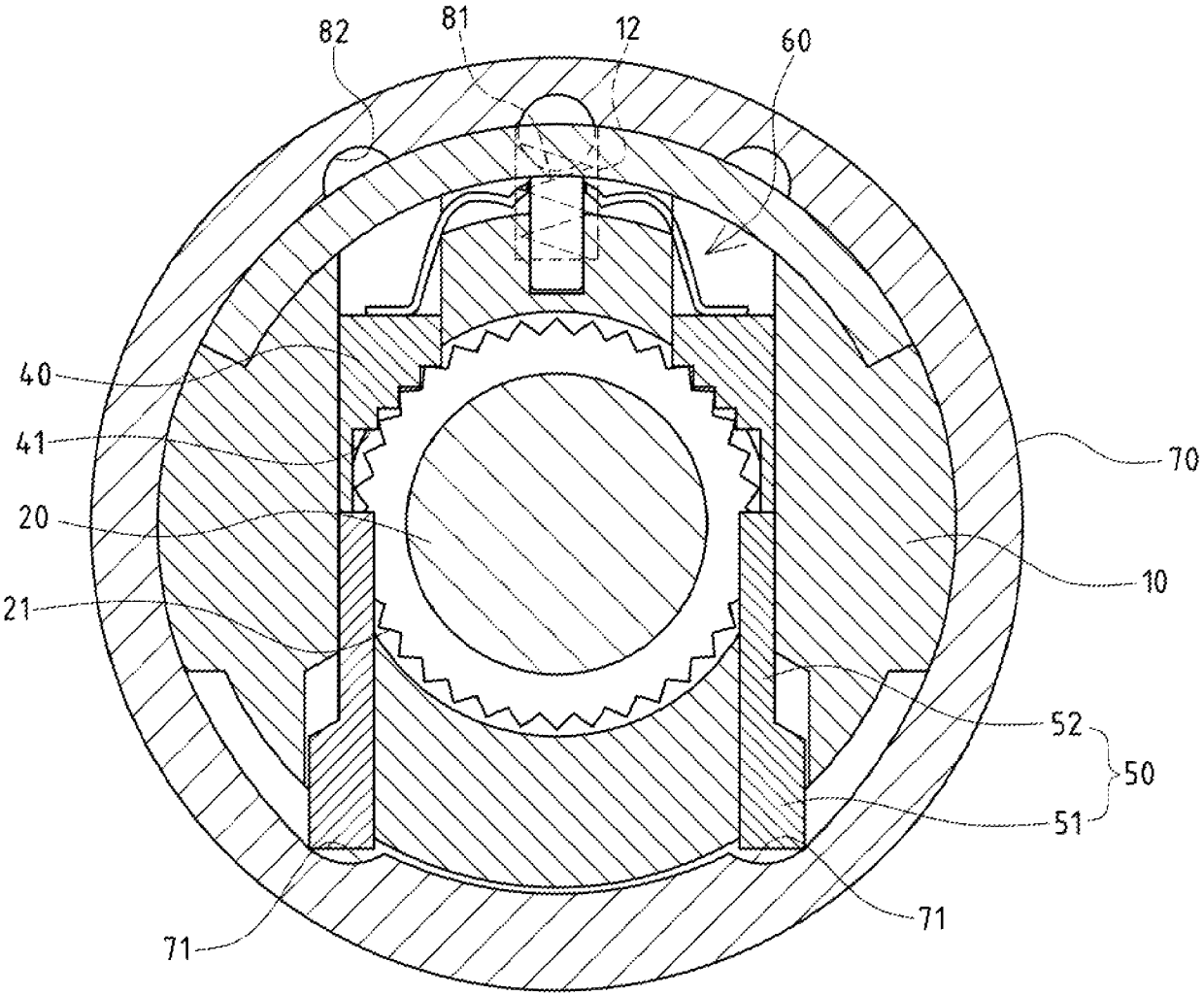
FIG. 3 is a sectional view of the present invention.
Figure 4:
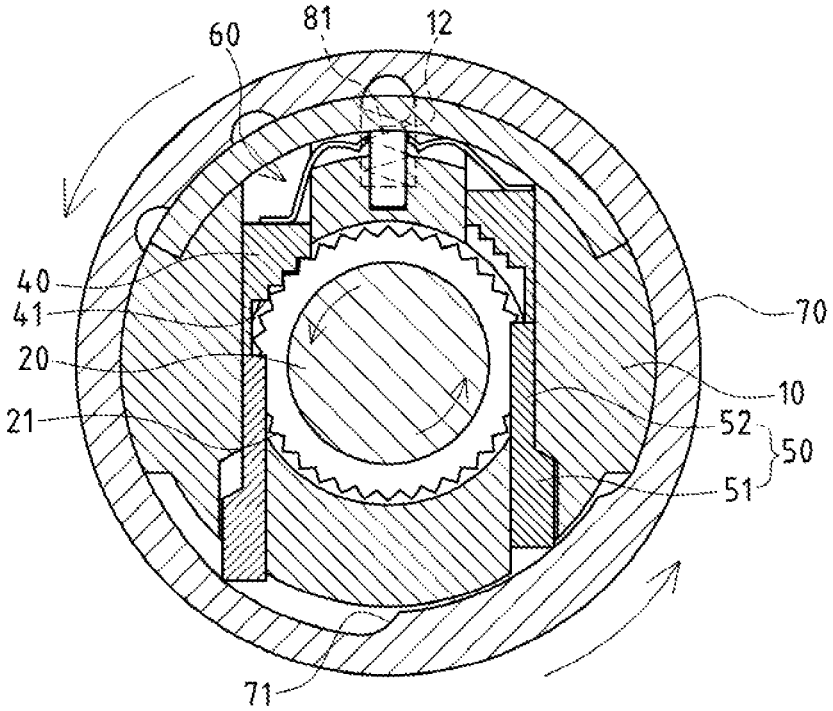
FIG. 4 is a sectional view of the present invention showing the activation state.
Figure 5:
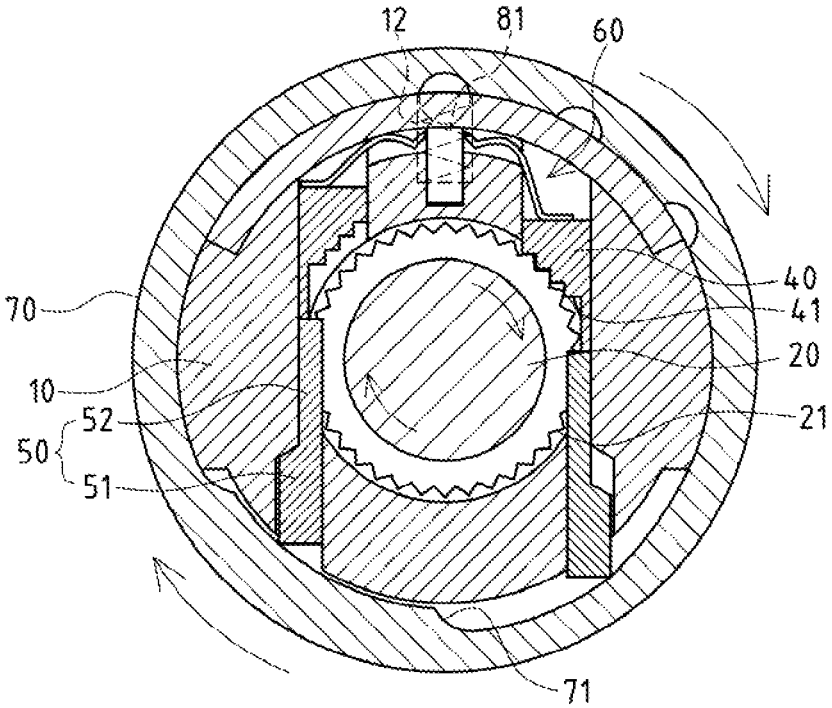
FIG. 5 is a sectional view of the present invention showing the activation state.

FIGS. 1-5 depict preferred embodiments of the ratchet screwdriver's steering and positioning structure of the present invention with seating functions, which, however, are provided, for only explanatory objective. The steering and positioning structure 05 is mounted into a preset ratchet screwdriver A, so as to control the positive, reverse or bi-directional rotation mode and positioning state of the shaft lever of the ratchet screwdriver A.

The steering and positioning structure 05 comprises a main body 10, at one end of which a mating portion 101 is formed to be incorporated onto the ratchet screwdriver 05. A central axle hole 11 is transversely set across the main body 10.

A ratchet assembly 20 is rotarily set into the central axle hole 11 of the main body 10. Multiple ratchets 21 with tine teeth pattern are arranged on the predefined periphery of the ratchet assembly 20, and a coupling portion 22 is formed onto one end of the ratchet assembly 20 located towards the central axle hole 11, enabling insertion of the shaft lever of said ratchet screwdriver A. In the preferred embodiment, one end of said ratchet assembly 20 is extended to form a rod portion 201, and the coupling portion 22 is formed at one end of the rod portion 201. When the ratchet assembly 20 is set into the central axle hole 11 of the main body 10, the rod portion 201 is extended out of the main body 10 (in collaboration with FIG. 2).

Two radial holding tanks 30 are arranged vertically in parallel across the main body 10 correspondingly to the central axle hole 11. The radial holding tanks 30 are defined to form an upper chamber 31 and a lower chamber 32, and located correspondingly at two lateral sides of the ratchets 21 of the ratchet assembly 20.

Two upper snapping blocks 40 in a multi-tooth meshing pattern are separately assembled into the upper chamber 31 of the radial holding tank 30. Said upper snapping blocks 40 are fabricated by means of powder metallurgy and demolding to form the predefined blocks. Stepped multiple snapping teeth 41 are formed OP the upper snapping, blocks 40 correspondingly to the ratchets 21 of the ratchet assembly 20, enabling multi-tooth meshing with the ratchets 21 of the ratchet assembly 20.

Two downward abutting pieces 50 are separately assembled into the lower chamber 32 of the radial holding tank 30 in a vertical sliding state. Said downward abutting pieces 50 comprise of a cross frame 51 and limited abutting portions 52. The top of the limited abutting portion 52 is normally extended upwards to be abutted onto the bottom of the upper snapping block 40.

An elastic abutting member 60 is assembled above two upper snapping blocks 40 of the main body 10, and used to flexibly press downwards two upper snapping blocks 40. So, the upper snapping blocks 40 in normal state are meshed with the ratchet assembly 20. Said elastic abutting member 60 allows the spring strip (or spring) to be sealed onto the radial holding tank 30 by a cover, but not limited to this.

A revolving drum 70 is sleeved on the periphery of the main body 10 in a rotatable state. Two grooves 71 are set at interval on inner wall of the revolving drum 70 correspondingly to the downward abutting pieces 50, such that the bottom of the cross frame 51 of the downward abutting pieces 50 could be snapped-in. When the revolving drum 70 is rotated positively or reversely (in collaboration with FIGS. 4, 5), the bottom of cross frame 51 of one downward abutting piece 50 is disengaged from the groove 71, and shifted upwards under the pushing of the inner wall of the revolving drum 70. Then, the limited abutting portions 52 of the downward abutting pieces 50 push upwards the corresponding upper snapping blocks 40, so that the upper snapping blocks 40 are disengaged from the ratchet assembly 20 to switch the rotatable direction of the ratchet screwdriver A.

A revolving drum split positioning member 80 is assembled onto the revolving drum 70 correspondingly to the main body 10, such that the revolving drum 70 can be positioned when its rotated to preset angle.

Based on the above-specified structural design, the upper snapping blocks 40 of the present invention are activated in tune with the downward abutting pieces 50, such that the upper snapping blocks 40 could be formed by means of powder metallurgy and demolding, meanwhile multiple snapping teeth 41 could be formed on the snapping block 40. As the snapping teeth 41 could be mated with the ratchets 21 of the ratchet assembly 20 in multi-tooth meshing pattern, the present invention could meet the multi-tooth meshing structural demands for convenient forming, and also improve substantially the torsion of the ratchet screwdriver A, enhance the ease-of-operation and mass production for higher economic benefits.

Figure 6:
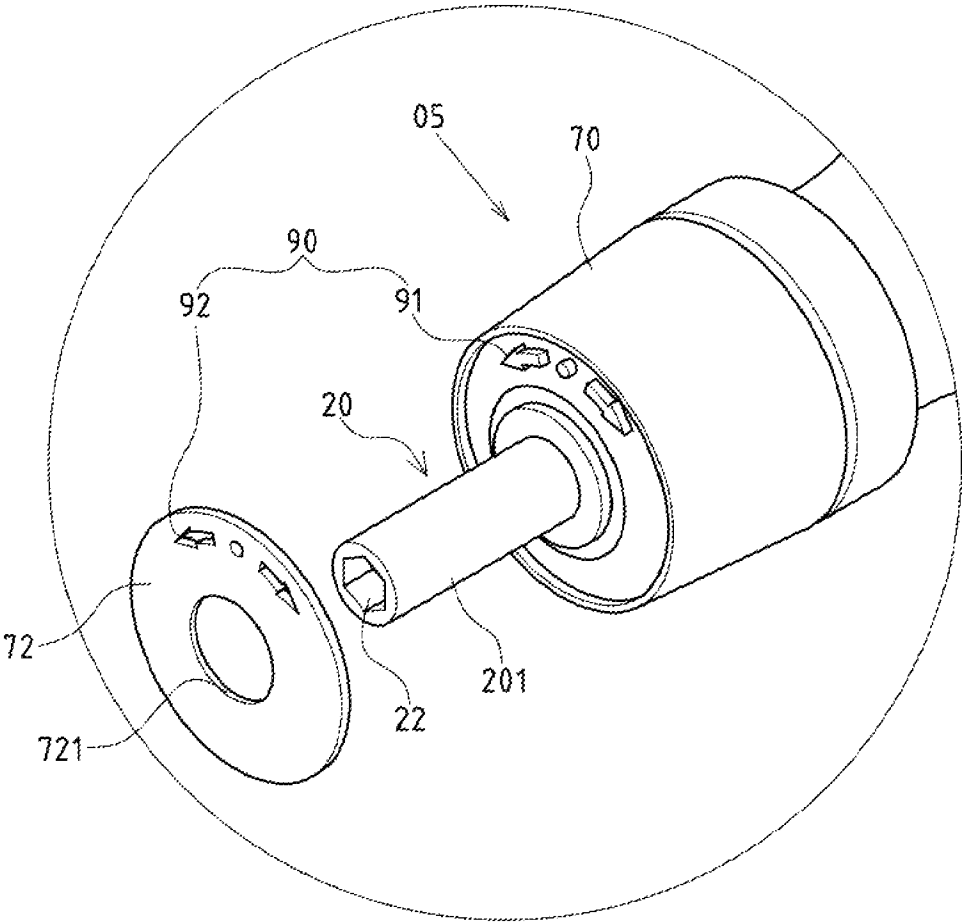
FIG. 6 is a partially enlarged view of the present invention with direction identifying portion.

Referring to FIG. 1, the revolving drum split positioning member 80 comprises of an elastic pushing member 81 in a chamber 12 set on top of the main body 10, and a few locating flanges 82, arranged at interval On the inner wall of the revolving drum 70 correspondingly to the elastic pushing member 81. When the revolving drum 70 is rotated to preset angles, it can be positioned as the elastic pushing member 81 is locked onto different locating, flanges 82. Said elastic pushing member 81 is implemented by pushing with the help of spring and bead, but not limited to this Referring to FIG. 6, a direction identifying portion 90 is arranged at a preset location of the revolving drum 70, enabling the users to identify the current rotating position of the revolving drum 70. Of which an end cover 72 with round opening 721 is assembled at front surface of the revolving drum 70. Said direction identifying portion 90 comprises of a flange 91 of predefined patterns and colors formed on the front surface of the revolving drum 70 and a through-hole 92 set on the end cover 72 correspondingly to the flange 91. When the end cover 72 is installed on the front surface of the revolving drum 70, the flange 91 can be extended into the through-hole 92 of the end cover 72, so that the users could use the direction identifying portion 90 from the front side of the revolving drum 70 to improve the operational convenience. Of which, the round opening 721 of the end cover 72 is designed into as reducing pattern. When the end cover 72 is installed on the from surface of the revolving drum 70, the rod portion 201 of the ratchet assembly 20 passes through the round opening 721, where the rod portion 201 of the ratchet assembly 20 is limited to prevent swaying of the ratchet assembly 20 so as to improve the assembly stability of the ratchet assembly 20.

Figure 7:
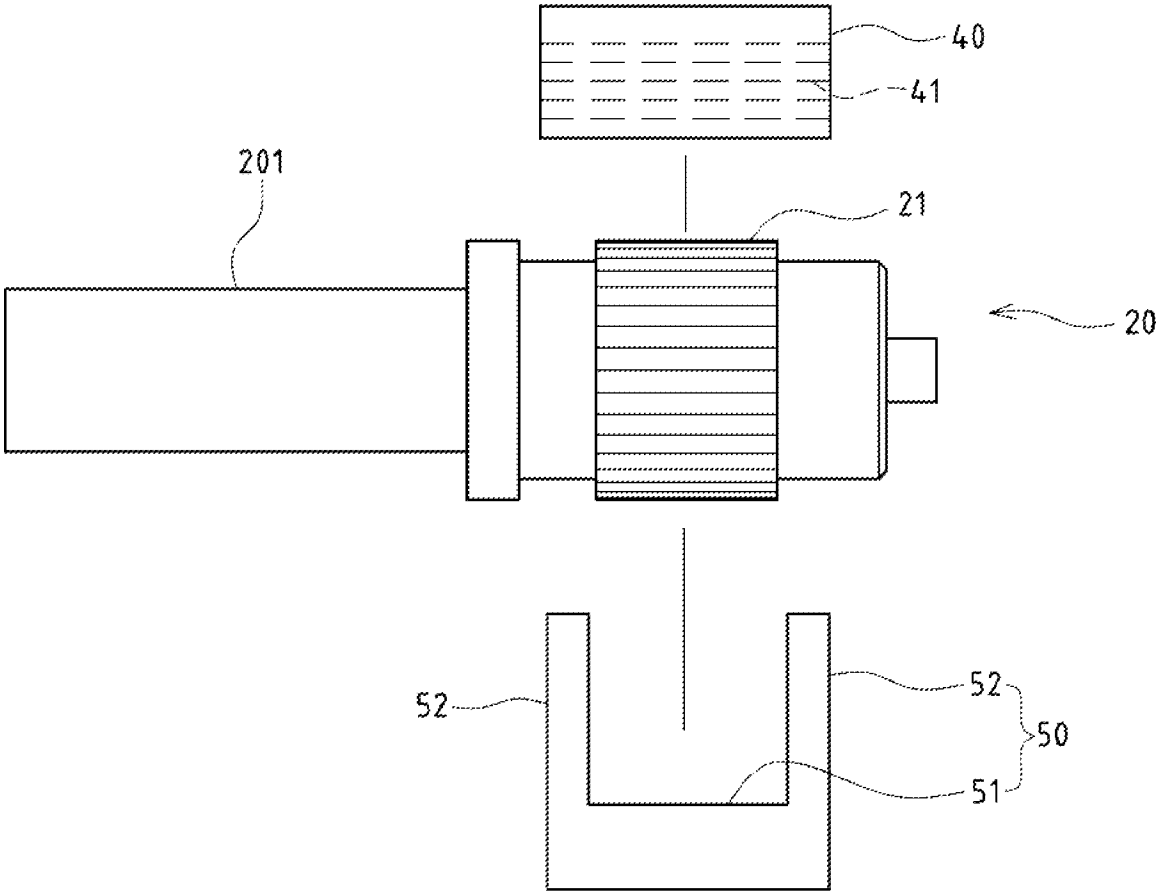
FIG. 7 is a plane view of a structural pattern of the upper snapping blocks and downward abutting pieces of the present invention.

Referring to FIG. 7, the limited abutting portions 52 of the downward abutting pieces 50 are formed at two sides of the cross frame 51, such that the downward abutting pieces 50 are set in a □-shaped pattern; and the limited abutting portions 52 can be located opposite to left and right sides of the ratchets 21 of the ratchet assembly 20, so to limit the accommodating state of the ratchet assembly 20.

Figure 8:
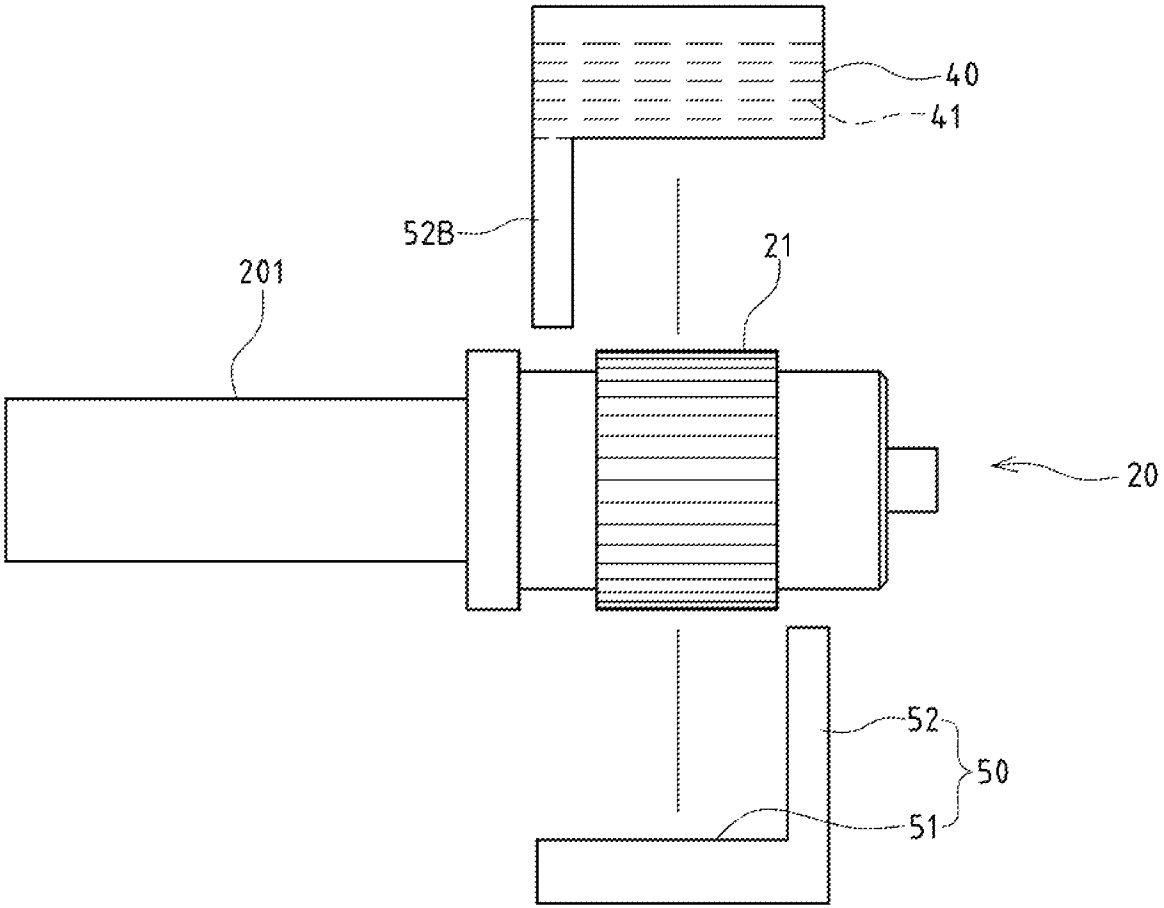
FIG. 8 is a plane view of another structural pattern of the upper snapping blocks and downward abutting pieces of the present invention.

Referring to FIG. 8—another preferred embodiment of the upper snapping blocks 40 and the downward abutting pieces 50, wherein the limited abutting portions 52 of the downward abutting pieces 50 are only formed at one side of the cross frame 51, and the lower side of the upper snapping block 40 is also extended to form a limited abutting portion 52B, such that the upper snapping blocks 40 and the limited abutting portions 52B, 52 of the downward abutting pieces 50 are separately located opposite to left and right sides of the ratchets 21 of the ratchet assembly 20. With this design, the ratchet assembly 20 could be driven and limited at proper location; of which, the limited abutting portion 52B must be formed onto one side of the upper snapping block 40 opposite to the rod portion 201 of the ratchet assembly 20. When the ratchet screwdriver A is used, the limited abutting portion 52B may not interfere with one side of the ratchets 21 of the ratchet assembly 20 (the ratchet assembly 20 is pushed inwards when a force is applied by the ratchet screwdriver A), avoiding inability of disengagement of the upper snapping blocks 40 from the ratchets 21.

I claim:

1. A steering and positioning assembly for mounting into a ratchet screwdriver so as to control a rotation mode and positioning state of a shaft lever of the ratchet screwdriver, the steering and positioning assembly comprising:

a main body having a mating portion formed at one end thereof, said mating portion adapted to be connected to the ratchet screwdriver, said main body having a central axle hole extending across said main body;

a ratchet assembly rotatably mounted into said central axle hole of said main body, said ratchet assembly having multiple ratchets with a fine teeth pattern arranged on a periphery of said ratchet assembly, said ratchet assembly having a coupling portion formed at one end of said ratchet assembly adjacent said central axle hole, said coupling portion adapted to enable insertion of the shaft lever of the ratchet screwdriver;

a pair of radial holding tanks arranged vertically in parallel relationship across said main body in relation to said central axle hole, each of said pair of radial holding tanks defining an upper chamber and a lower chamber, said pair of radial holding tanks arranged at a pair of lateral sides of the ratchet assembly;

a pair of upper snapping blocks arranged in a multi-tooth meshing pattern, said pair of upper snapping blocks separately assembled into the upper chamber, each of said pair of upper snapping blocks being formed by powder metallurgy and molded into a block shape, each of said pair of upper snapping blocks having multiple snapping teeth arranged so as to mesh with the ratchets of said ratchet assembly;

a pair of downward abutting pieces separately assembled in vertically slidable relationship into the lower chamber of said pair of radial holding tanks, each of said pair of downward abutting pieces having a cross-frame and an abutting portion, a top of the abutting portion normally extended upwardly so as to abut a bottom of the upper snapping block;

an elastic abutting member assembled above said pair of upper snapping blocks, said elastic abutting member urging said pair of upper snapping blocks downwardly such that said pair of upper snapping blocks are normally meshed with said ratchet assembly;

a revolving drum sleeved onto a periphery of said main body, said revolving drum having a pair of grooves in spaced relation on an inner wall thereof in correspondence to said pair of downward abutting pieces such that a bottom of said cross-frame snaps therein, a bottom of said cross-frame of one of said pair of downward abutting pieces is disengaged from the groove when said revolving drum is rotated in one direction or the other direction, said bottom of said cross-frame being shiftable upwardly by a pushing of said inner wall of said revolving drum, said pair of upper snapping blocks being disengaged from said ratchet assembly so as to switch a rotatable direction of the ratchet screwdriver when the abutting portions of said pair of downward abutting pieces push upwardly toward the corresponding upper snapping blocks; and a split positioning member assembled onto the revolving drum in correspondence to said main body so as to position said revolving drum when said revolving drum is rotated to a desired position.

2. The steering positioning assembly of claim 1, the abutting portions of said pair of downward abutting pieces being formed at opposite sides of said cross-frame such that said pair of downward abutting pieces are of a generally U-shaped configuration , the abutting portions being located at opposite sides of the ratchets of said ratchet assembly.

3. The steering positioning assembly of claim 1, the abutting portions of said pair of downward abutting piece being formed on only one side of said cross-frame, a lower side of the upper snapping block extending so as to form the abutting portion such that said pair of upper snapping blocks and the abutting portions of said pair of downward abutting pieces are separately located on opposite sides of the ratchets of said ratchet assembly.

* * * * *